US008171760B2

(12) United States Patent
Yen et al.

(10) Patent No.: US 8,171,760 B2
(45) Date of Patent: May 8, 2012

(54) PADLOCK WITH OPEN INDICATION FUNCTION

(75) Inventors: An-Ting Yen, Chung-Ho (TW); Chun-Sheng Wu, Chung-Ho (TW)

(73) Assignee: Sinox Co., Ltd, Chung-Ho, Taipei County (TW)

( * ) Notice: Subject to any disclaimer, the term of this patent is extended or adjusted under 35 U.S.C. 154(b) by 332 days.

(21) Appl. No.: 11/729,789

(22) Filed: Mar. 30, 2007

(65) Prior Publication Data

US 2007/0227202 A1 Oct. 4, 2007

(30) Foreign Application Priority Data

Mar. 31, 2006 (TW) ..... 95111503 A

(51) Int. Cl.
*E05B 37/00* (2006.01)
*E05B 41/00* (2006.01)

(52) U.S. Cl. ..... 70/25; 70/21; 70/284; 70/285; 70/432

(58) Field of Classification Search ..... 70/20–22, 70/24–29, 284, 285, 330–332, 432, 435, 70/437, 441
See application file for complete search history.

(56) References Cited

U.S. PATENT DOCUMENTS 6,029,481 A * 2/2000 Lai ..... 70/25
6,848,283 B1 * 2/2005 Lin ..... 70/21
6,860,125 B1 * 3/2005 Yu ..... 70/25
6,877,345 B1 * 4/2005 Misner et al. ..... 70/25
6,904,776 B1 * 6/2005 Lin ..... 70/25
7,047,773 B1 * 5/2006 Lin ..... 70/25
7,100,401 B2 * 9/2006 Yu ..... 70/21
7,140,209 B2 * 11/2006 Lai ..... 70/25
7,155,944 B1 * 1/2007 Lin ..... 70/21
7,174,756 B2 2/2007 Ling et al.
7,210,318 B2 * 5/2007 Yu ..... 70/21
7,628,045 B2 * 12/2009 Yu ..... 70/21
2004/0226323 A1 * 11/2004 Ling et al. ..... 70/25
2005/0034492 A1 * 2/2005 Yu ..... 70/25
2005/0039501 A1 * 2/2005 Yu ..... 70/29
2005/0044901 A1 * 3/2005 Yu ..... 70/25
2005/0262902 A1 * 12/2005 Ling et al. ..... 70/21
2006/0150690 A1 * 7/2006 Lai et al. ..... 70/21
2006/0236731 A1 * 10/2006 Yu ..... 70/21
2006/0251325 A1 * 11/2006 Florin et al. ..... 382/173
2006/0266084 A1 * 11/2006 Kuo et al. ..... 70/21

* cited by examiner

*Primary Examiner* — Carlos Lugo
*Assistant Examiner* — Alyson M Merlino
(74) *Attorney, Agent, or Firm* — Muncy, Geissler, Olds & Lowe, PLLC

(57) ABSTRACT

A padlock having an open indication function is provided. The padlock includes a first lock, a driving device, and an indication device. A portion of the driving device is movably disposed within a key hole of the first lock. The indication device moves in combination with the driving device. A bottom end of the indication device is connected to a top end of the driving device. In addition, the indication device is selectively disposed between a first position and a second position. When a key is inserted into the key hole of the first lock, the key pushes the driving device to force the indication device moving from the first position to the second position.

19 Claims, 14 Drawing Sheets

PADLOCK WITH OPEN INDICATION FUNCTION

BACKGROUND OF THE INVENTION

1. Field of the Invention

The present invention generally relates to a padlock having an open indication function, and more particularly to a padlock having an open indication function and applied in suitcases and travel bags needed to pass the security check.

2. Description of the Prior Art

For a long time, padlock is widely used in various devices and products needed to be secured. The products, such as cabinets, suitcases, travel bags and any electronic devices, use padlocks to avoid someone to open and take out the products. Tourists normally put a padlock on the suitcases to avoid from being stolen during travel by air, sea or land transportation.

However, the security check during transporting is more and more serious, the baggage and the suitcases used during travel are needed to pass several checks, especially for the baggage transporting by the airline. In order to make sure the travel safety, the securities in the airport need to open the baggage after check-in. However, most of baggage is locked and difficult to open and it would cause some trouble when doing the security check.

In order to solve those problems described above, a padlock with two cores is conventionally used in the baggage needed to pass the security check. The owner of the baggage has a key or password to open one core of the padlock and the securities have a different key to open another core of the padlock. The key and the core of the corresponding padlock are with unique standard used by securities for different types of padlocks. Therefore, the securities can use only one key to open any different types of padlocks. The keys used by the securities are needed to collect together for security reason.

SUMMARY OF THE INVENTION

An object of the present invention is to provide a padlock having an opening indication function.

Another object of the present invention is to provide a padlock having a function for indicating the padlock had been tried to open.

The padlock having an open indication function in the present invention includes a first lock, a driving device and an indication device. A portion of the driving device is movably disposed within a key hole of the first lock. The indication device moves together with the driving device. In a preferred embodiment, the bottom end of the indication device is connected to the top end of the driving device. In addition, the indication device is alternatively disposed between a first position and a second position. When a key is inserted into the key hole of the first lock, the key pushes the driving device to force the indication device shifting from the first position to the second position.

In the preferred embodiment, the padlock further includes an engaging device movably disposed within the casing. When the indication device is shifted to the second position, the indication device is kept in the second position by connecting the engaging device and the indication device. Besides, in the preferred embodiment, the padlock further includes a second lock and a connective device connected to the second lock. The connective device includes a driving unit relative to the holding device. When the second lock is in unlocked position, the second lock and the engaging device are pivotally moving and the driving unit drives the engaging device to shift a distance and release the indication device, which had been restricted to move.

DETAILED DESCRIPTION OF THE PREFERRED EMBODIMENT

Figure 1:
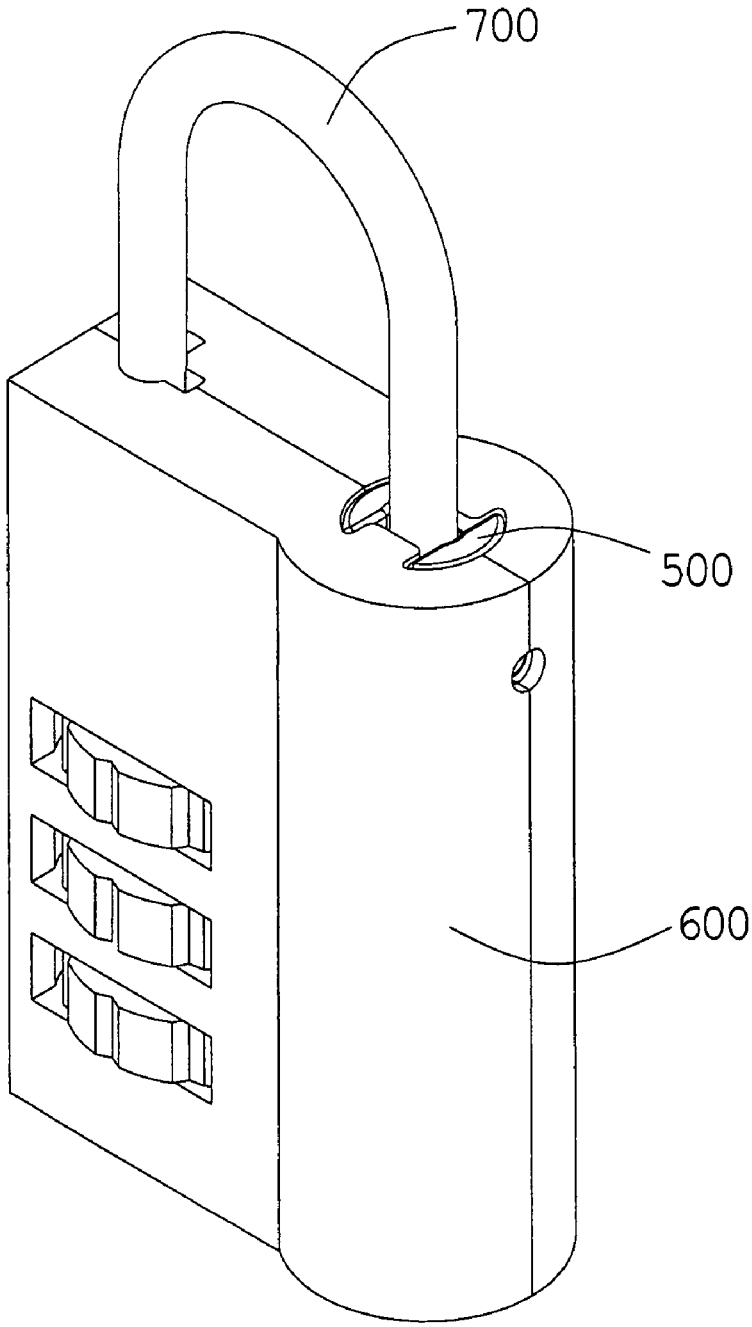
FIG. 1 shows a preferred embodiment in the present invention.

As shown in FIG. 1, a padlock with an open indication function is disclosed in the present invention. In a preferred embodiment, the padlock of the present invention is used in various suitcases and travel bags for passing the security check. Especially for the suitcases and the travel bags used by air, sea and land transportation.

Figure 2:
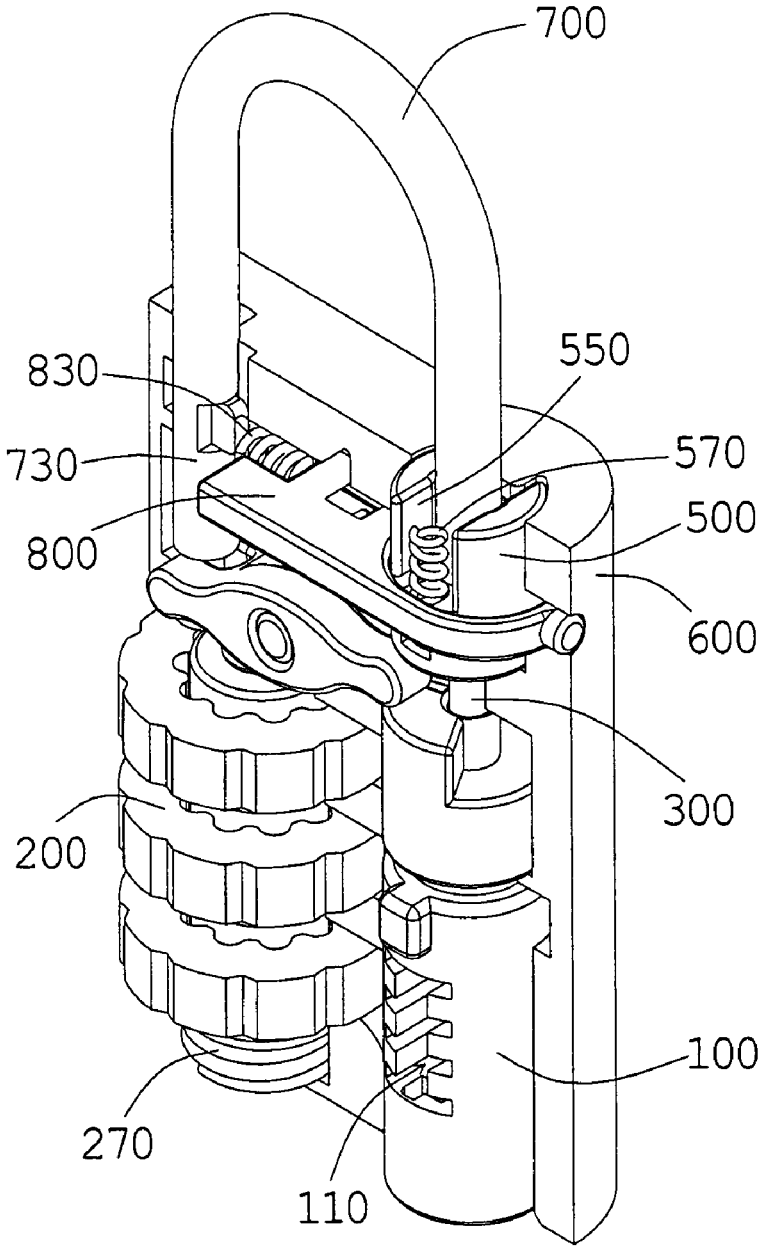
FIG. 2 illustrates an element assembly of the preferred embodiment in the present invention.
Figure 3:
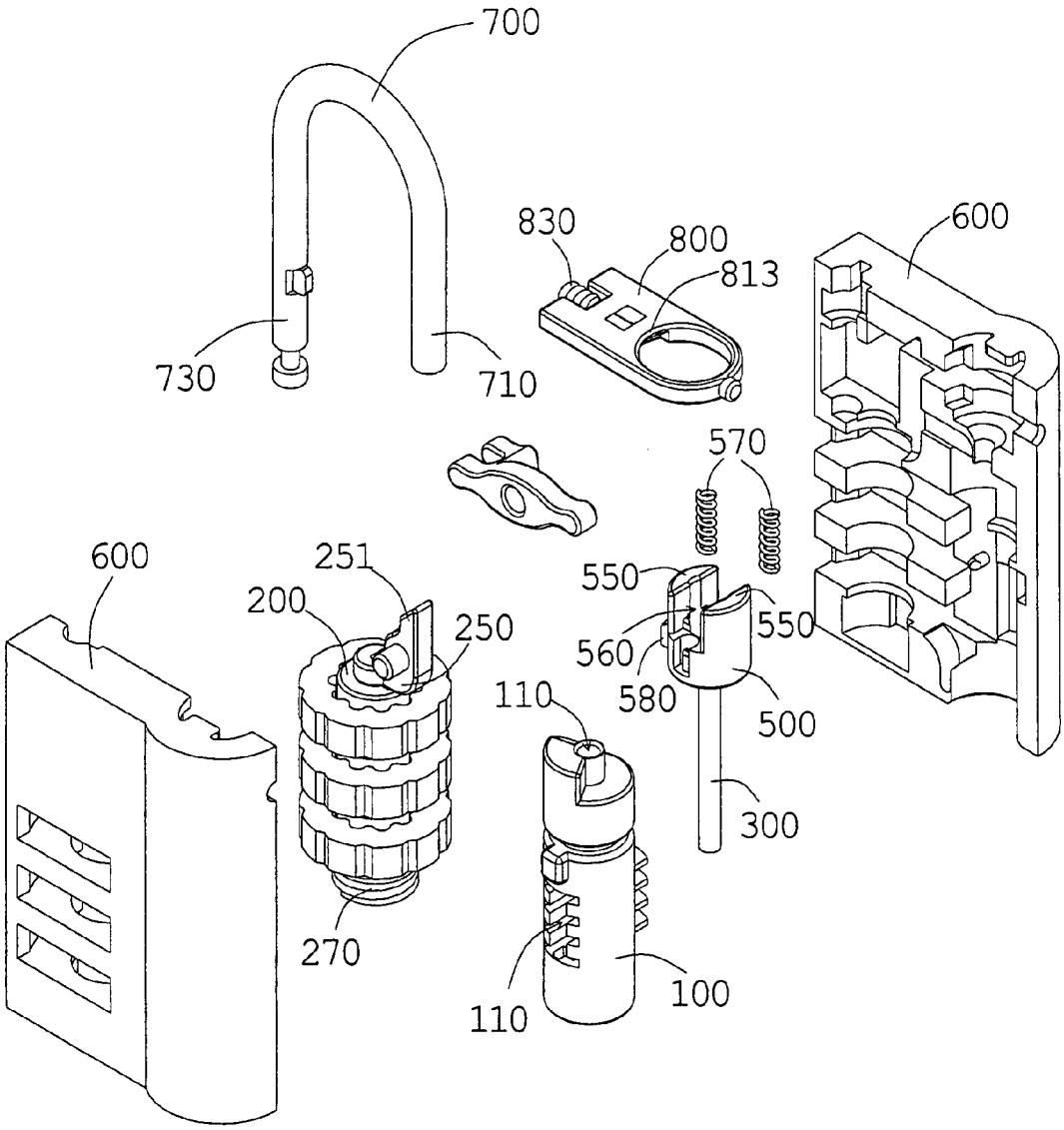
FIG. 3 is an exploded view of the preferred embodiment shown in FIG. 2.
Figure 4A:
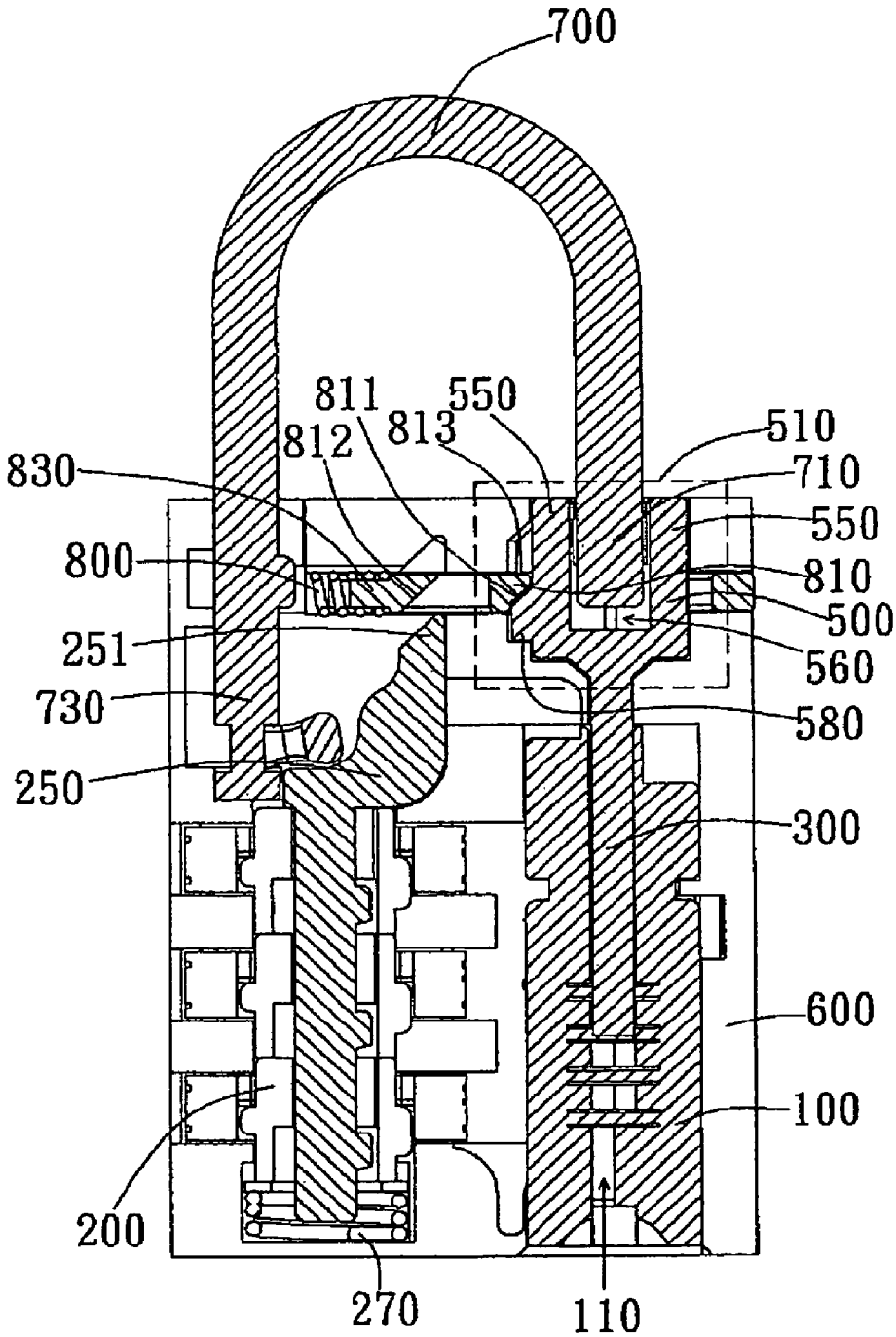
FIG. 4*a* is a cross-sectional view of the preferred embodiment shown in FIG. 2 when the indication device is located in the first position.
Figure 4B:
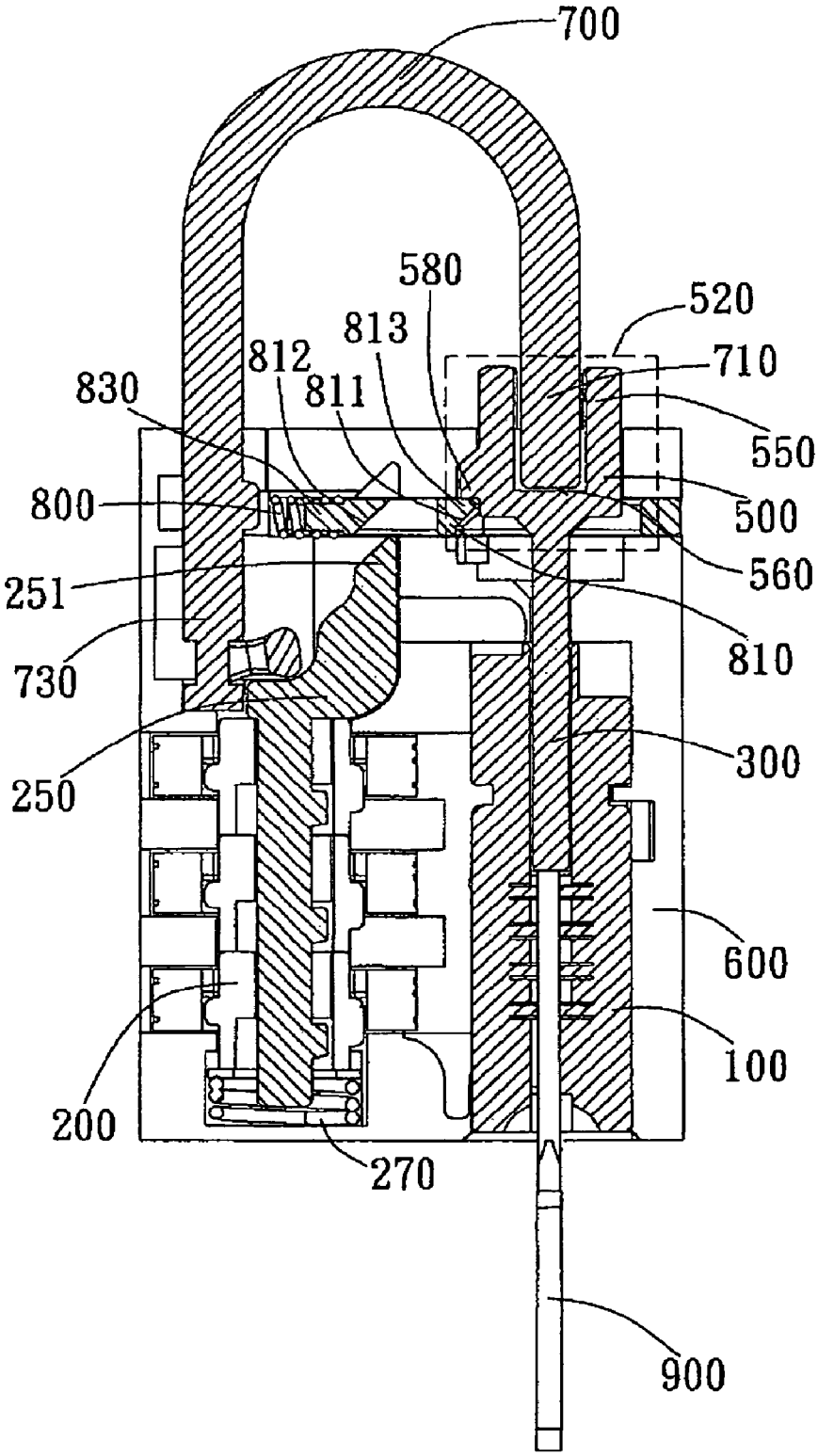
FIG. 4*b* is a cross-sectional view of the preferred embodiment shown in FIG. 2 when the indication device is located in the second position.

The padlock having an open indication function in the present invention includes a first lock 100, a driving device 300 and an indication device 500. As shown in FIG. 2, FIG. 3 and FIG. 4*a*, the first lock 100 includes a key hole 110 formed therein. A portion of the driving device 300 is movably disposed within the key hole 110. As the preferred embodiment shown in FIG. 2 and FIG. 4*b*, the first lock 100 is a key lock core and the key hole 110 is used for inserting the key 900 to open the padlock. When the key 900 is inserting in the key hole 110, the top end of the key 900 will touch the bottom end of the driving device 300 and force the driving device 300 to move along the key inserting direction, as shown in FIG. 4*b*.

The indication device 500 moves together with the driving device 300. As the embodiment shown in FIG. 3, the bottom end of the indication device 500 is connected to the top end of the driving device 300. The connecting method described herein includes coupling, gluing, welding, locking, integrating and so on. In this embodiment, the corresponding moving relationship between the indication device 500 and the driving device 300 includes pulling and pushing each other. However, in other embodiments, the corresponding moving relationship between the indication device 500 and the driving device 300 is limited in the pushing relationship. That means that the indication device 500 and the driving device 300 are able to mutually push instead of mutually pulling.

The indication device 500 is alternatively disposed between the first position 510 and the second position 520. As the embodiments shown in FIG. 5*a* and FIG. 5*b*, the first position 510 is the position where the indication device 500 is stored within the casing 600. The second position 520 is the position where the indication device 500 extends out of the casing 600. In other words, the indication device 500 alternatively extends out of the casing 600.

Figure 5A:
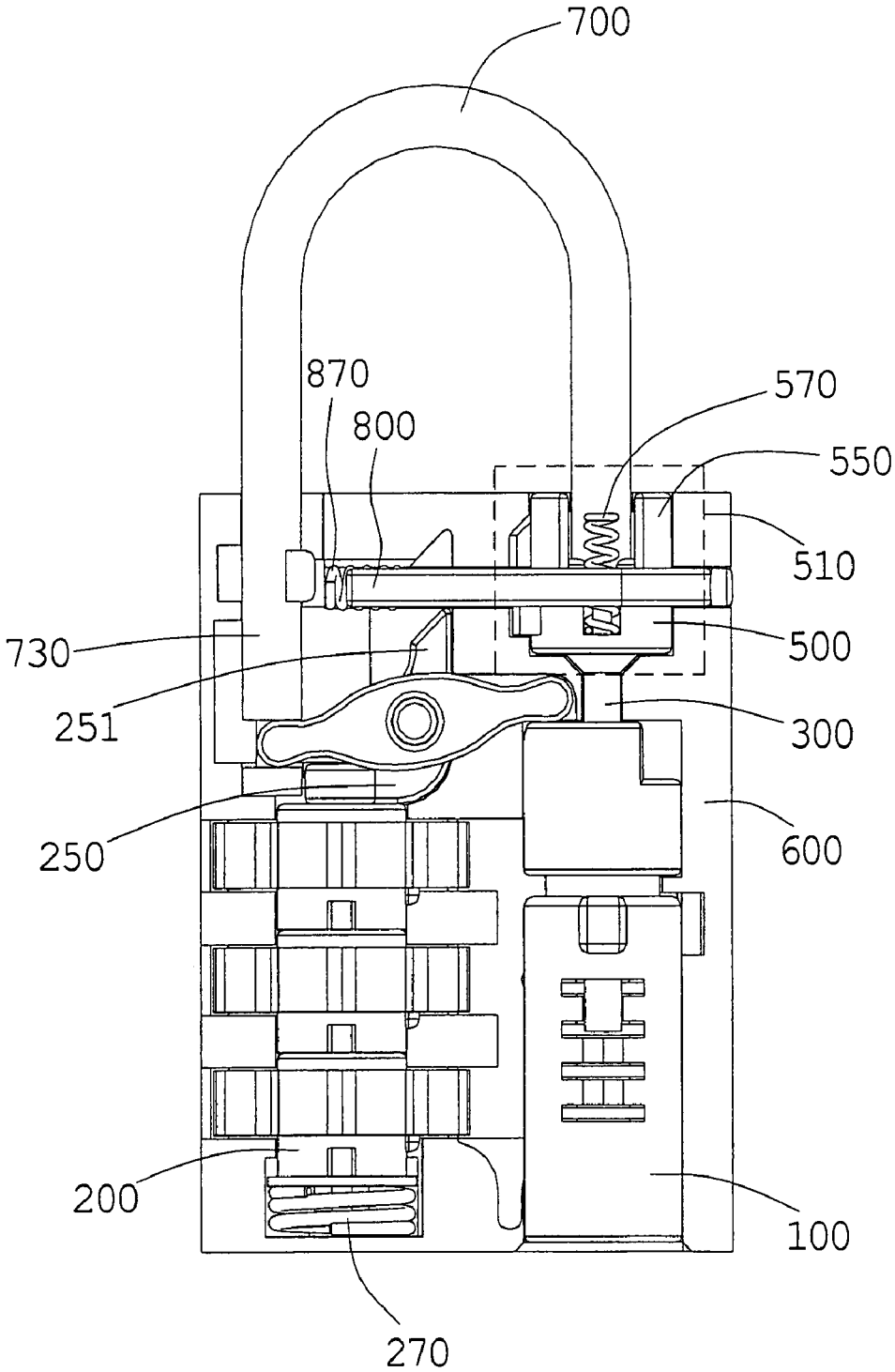
FIG. 5*a* is a side view of the embodiment shown in FIG. 2 when the indication device is located in the first position.
Figure 5B:
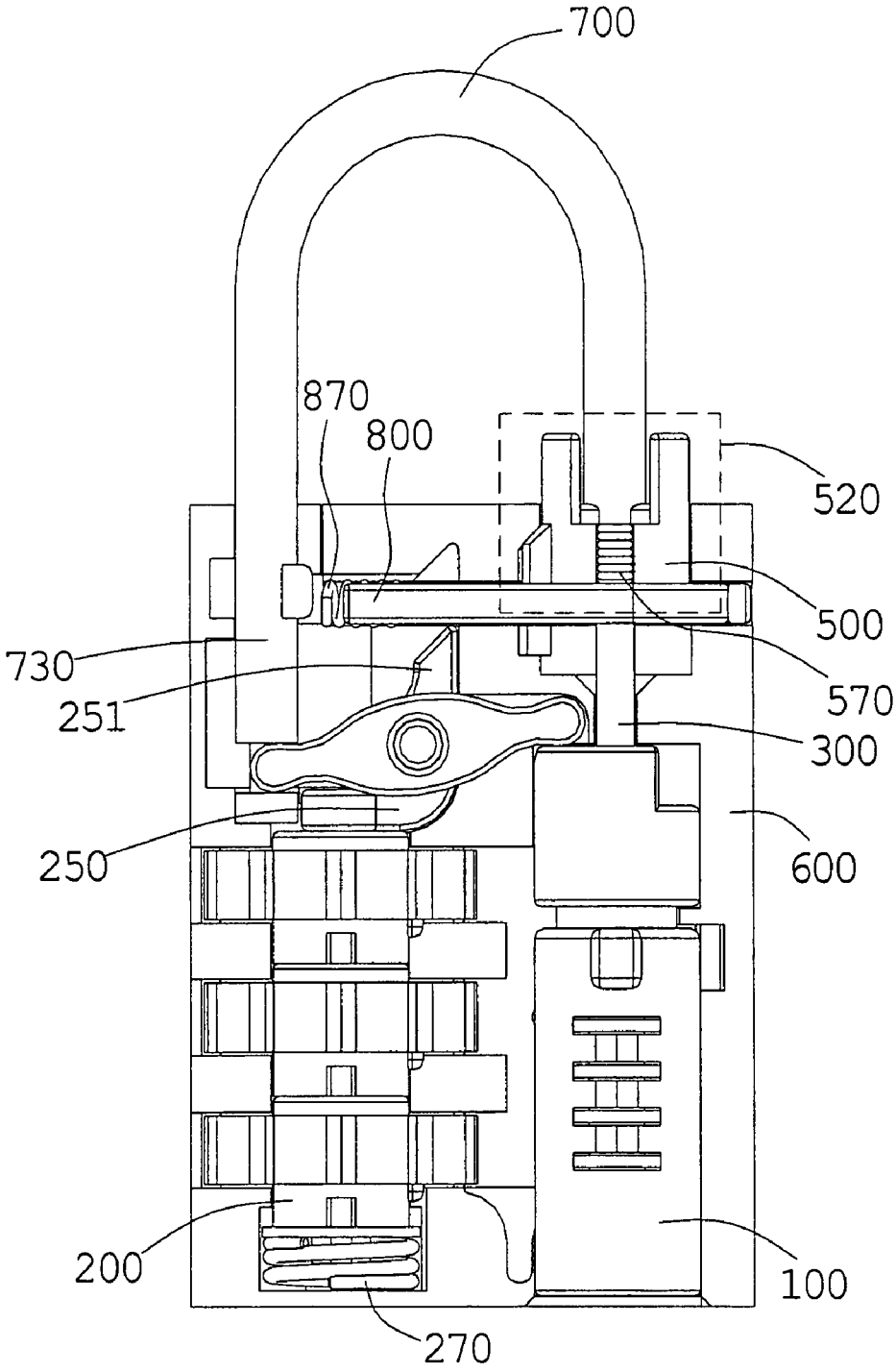
FIG. 5*b* is a side view of the embodiment shown in FIG. 2 when the indication device is located in the second position.

As shown in FIG. 4*a* and FIG. 5*a*, when the first lock 100 is locked, a portion of the driving device 300 is disposed within the key hole 110. At that time, the indication device 500 is in the first position 510 to point out the locking status. When someone is trying to open the padlock and insert the key into the key hole 110, as shown in FIG. 4*b* and FIG. 5*b*, the driving device 300 is ejected along the key 900 inserting direction and forces the indication device 500 moving from the first position 510 to the second position 520.

The embodiment shown in FIG. 2 further includes a shackle 700. The shackle 700 includes a free end 710 and a pivot end 730. The pivot end 730 is able to pivotally rotate and connect to the casing 600. The free end 710 is capable of rotating around the pivot end 730 to be the axis thereof. When the shackle 700 is in the lock position, the indication device 500 is relative to the position of the free end 710. In the preferred embodiment, as shown in FIG. 3, the indication device 500 includes two side walls facing each other and a channel 560 is formed between the two side walls. When the shackle 700 is in the lock position, as shown in FIG. 2, FIG. 5*a*, and FIG. 5*b*, the free end 710 is located within the channel 560 between the two side walls 550. When the shackle 700 is in the unlock position and no matter the indication device 500 is either in the first position 510 or in the second position 520, the indication device 500 does not restrict the movement of the free end 710. However, in other embodiments, the indication device 500 is located in only one side of the free end 710 and is relative to the position of the free end 710.

The preferred embodiment of the present invention further includes an engaging device 800. The engaging device 800 is movably disposed within the casing 600. As the embodiment shown in FIG. 5*a* and FIG. 5*b*, the engaging device 800 is movable along the direction vertical to the shifting path of the indication device 500.

As shown in FIG. 4*a* and FIG. 5*a*, the indication device 500 is located in the first position 510. As shown in FIG. 4*b* and FIG. 5*b*, the indication device 500 is shifted to the second position 520. The engaging device 800 locates the indication device 500 in the second position 520. By engaging the engaging device 800 and the indication device 500 together, the indication device 500 is able to be in the second position 520.

Besides, the indication device 500 further includes a reverse device 570. The reverse device 570 is used to provide a reverse strength and force the indication device 500 to shift back from the second position 520 to the first position 510. As shown in FIG. 2 and FIG. 3, the reverse device 570 is a spring disposed between the indication device 500 and the casing 600. However, in a different embodiment, the reverse device 570 maybe an elastic strip or a plastic unit with elasticity. When the indication device 500 is in the second position 520 and is engaged with the engaging device 800, as shown in FIG. 5*b*, the reverse device 570 is stressed by the indication device 500 and the casing 600 and generates a reverse strength. When the engaging device 800 releases the indication device 500 and decontrols the limitation of the shifting of the indication device 500, the reverse strength generated by the reverse device 570 compels the indication device 500 to shift back from the second position 520 to the first position 510.

As the embodiment shown in FIG. 4*a* and FIG. 4*b*, the engaging device 800 includes a wedged structure 810 and a reverse device 830. The wedged structure 810 includes a first incline 811 and a first engaging end 813. The reverse device 830 is disposed in one end of the engaging device 800 and connected to the casing 600. The reverse device 830 is a spring. However, in a different embodiment, the reverse device 570 maybe an elastic strip or a plastic unit with elasticity. The indication device 500 also includes a second engaging end 580 relative to the first incline 811 and the first engaging end 813.

As shown in FIG. 4*a* and FIG. 4*b*, when the indication device 500 is shifted from the first position 510 to the second position 520, the second engaging end 580 of the indication device 500 slides along the first incline 811, and the engaging device 800 is shifted back to compress the reverse device 830. When the second engaging end 580 is departed from the first incline 811 to pass through the first engaging end 813, the reverse device 830 generates a reverse strength to force the engaging device 800 returning to the original position. At this moment, the first engaging end 813 is engaged with the second engaging end 580 and the indication device 500 is located in the second position 520.

The embodiment shown in FIG. 2 further includes a second lock 200 and a connective device 250. The second lock 200 is a combination lock. However, in a different embodiment, the second lock 200 maybe a key lock core. The second lock 200 is connected to the connective device 250. In this embodiment, as shown in FIG. 3, the connective device 250 is connected to the top end of the second lock 200. The connective device 250 includes a driving unit 251. The driving unit 251 is disposed and corresponding to the engaging device 800.

The second lock 200 and the connective device 250 are disposed within the house 600 and are movable along the axis of the second lock 200. As shown in FIG. 4*b* and FIG. 5*b*, there is a relative concave and a channel in the casing 600 to provide space and guidance for the second lock 200 and the connective device 250. When the second lock 200 is in unlocked position, as shown in FIG. 4*c* and FIG. 5*c*, the spring 270 pushes the second lock 200 and the connective device 250 to move axially and forces the driving unit 251 to drive the engaging device 800 to generate a shifting distance and release the indication device 500.

Figure 4C:
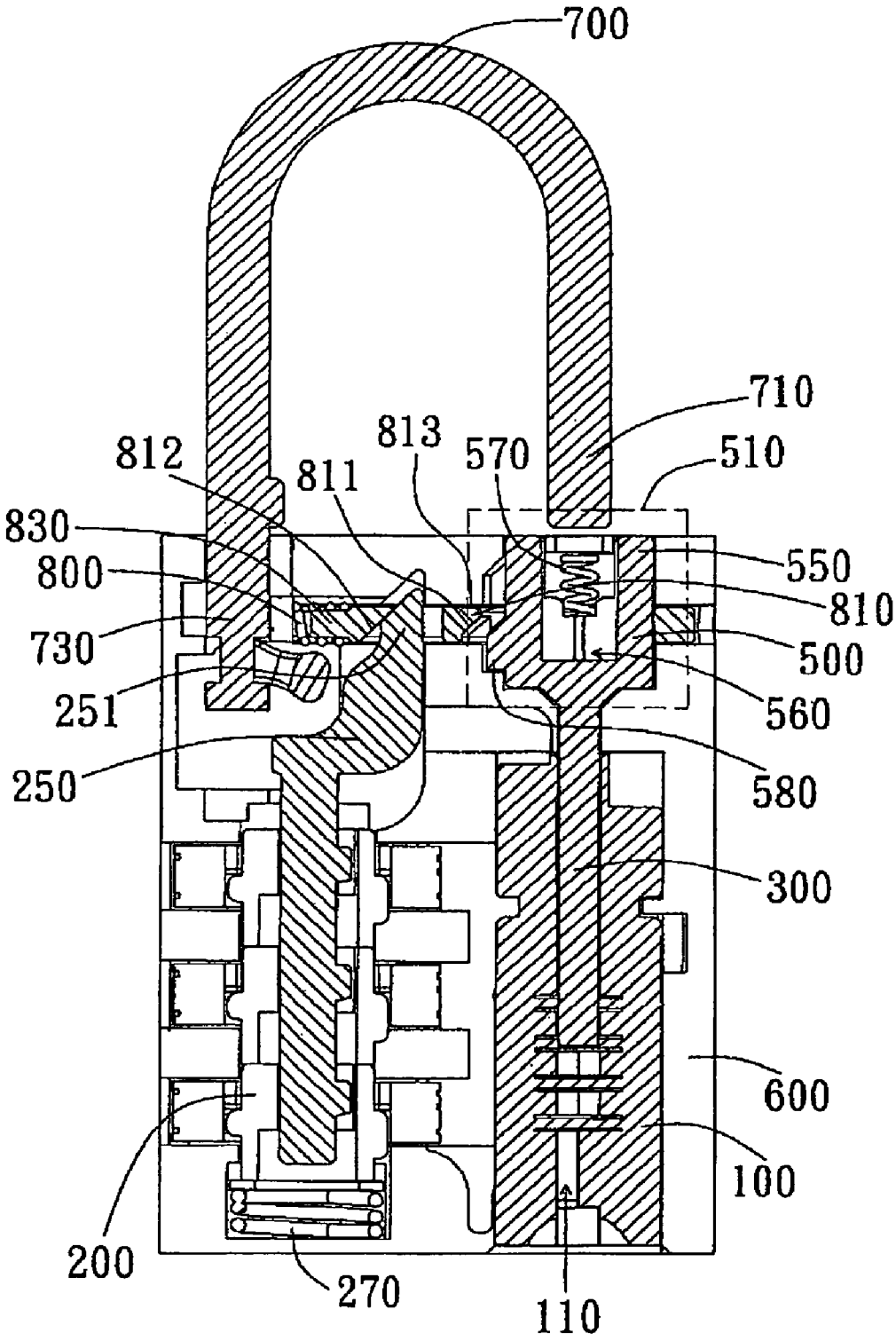
FIG. 4*c* is a cross-sectional view of the embodiment shown in FIG. 2 when the indication device is shifted back to the first position.
Figure 5C:
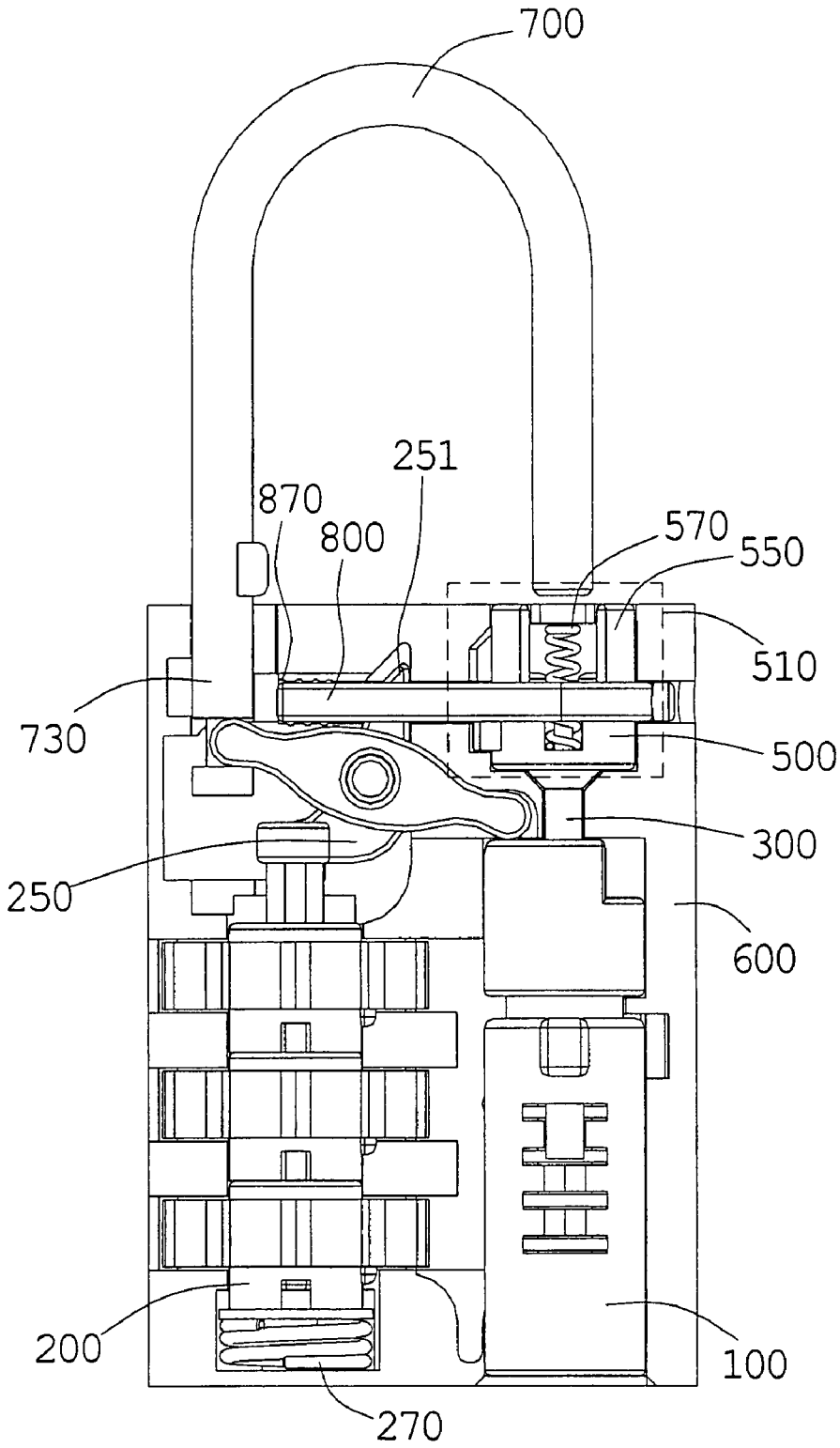
FIG. 5*c* is a side view of the embodiment shown in FIG. 2 when the indication device is shifted back to the first position.

In the preferred embodiment, as shown in FIG. 4*a*, FIG. 4*b* and FIG. 4*c*, the engaging device 800 includes a second incline 812 relative to the driving unit 251. When the connective device 250 is shifted to the engaging device 800, the driving unit 251 slides along the second incline 812 and forces the engaging device 800 to shift back. When the engaging device 800 is shifted back, the misalignment is occurred between the engagement of the second engaging end 580 of the indication device 500 and the first engaging end 813 of the engaging device 800. According to the reverse strength generated from the reverse device 570 of the indication device 500, the reverse strength forces the engaging device 800 to decontrol the limitation of the shifting of the indication device 500 and the indication device 500 is shifted back from the second position 520 to the first position 510 by the reverse strength generated from the reverse device 570 of the indication device 500.

Figure 6:
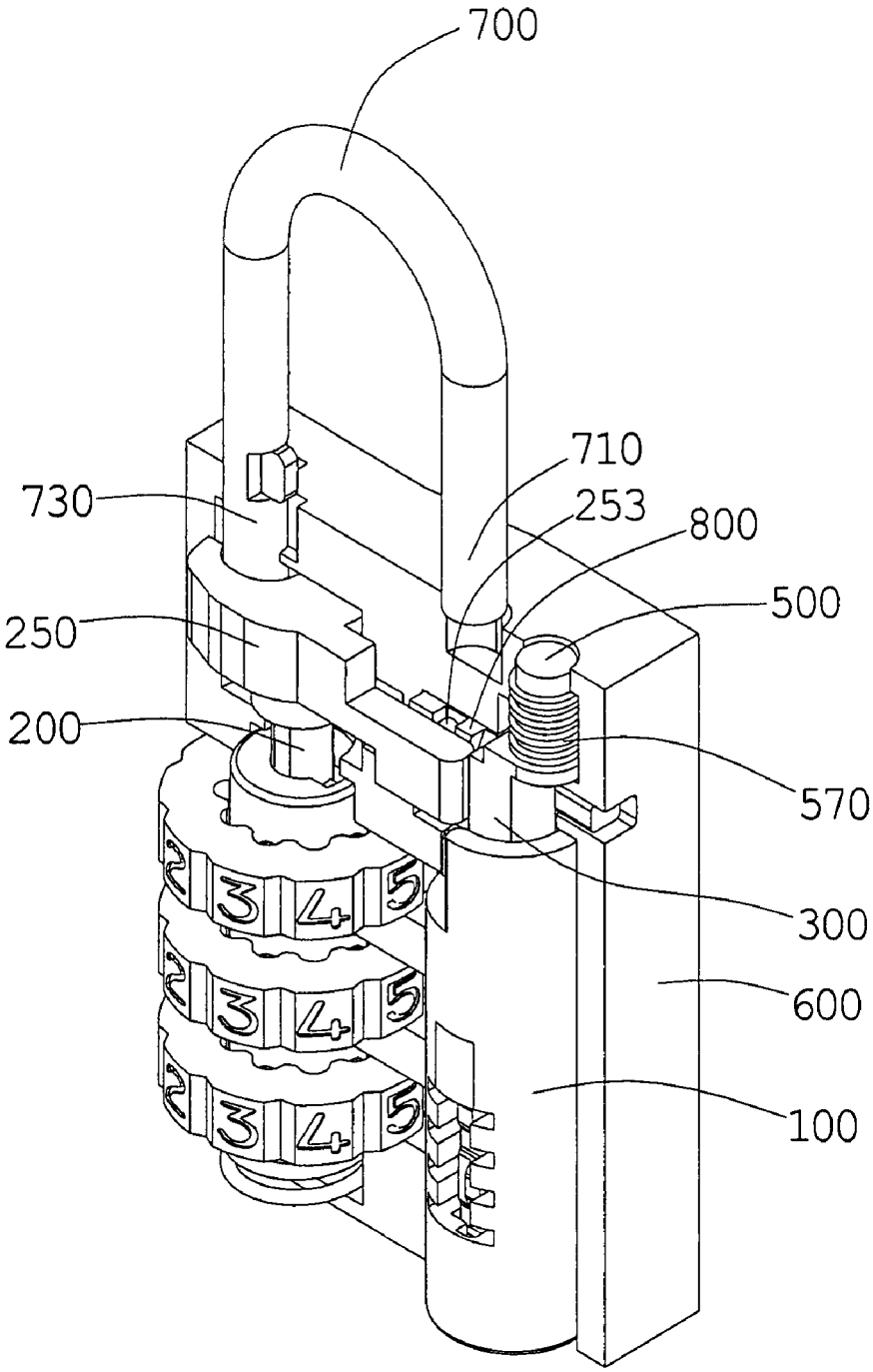
FIG. 6 is a 3-dimensional view of another embodiment in the present invention.
Figure 7:
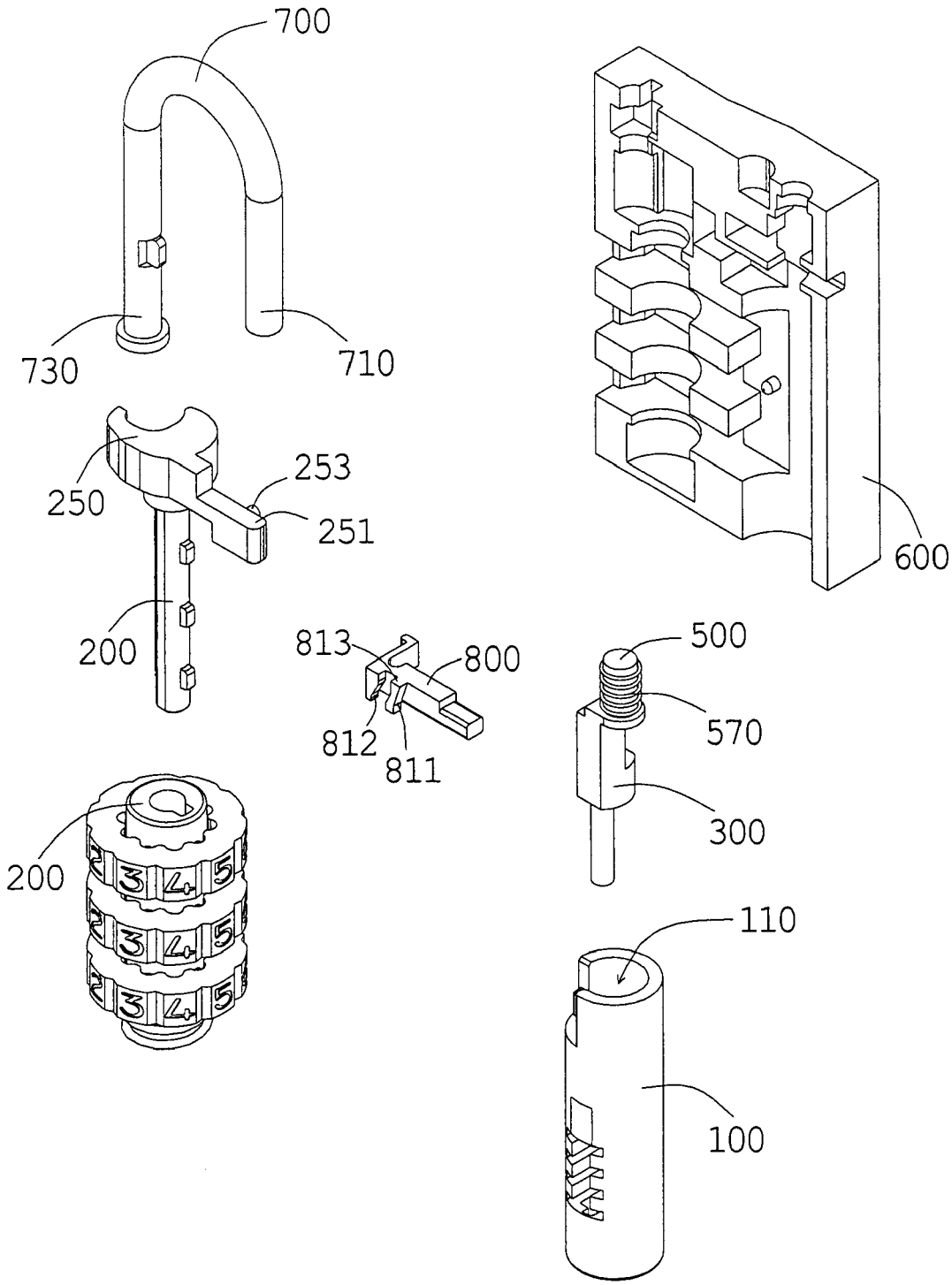
FIG. 7 is an exploded view of the embodiment shown in FIG. 6.

Another embodiment of the present invention is shown in FIG. 6 and FIG. 7. As shown in FIG. 6, the indication device 500 is disposed in one side of the free end 710 of the shackle 700. The indication device 500 includes a pillar, and the reverse device 570 is a spring sleeved on the indication device 500.

Besides, as shown in FIG. 7, the connective device 250 is vertical to the second lock 200, and the connective device 250 is connected to the top end of the second end 200. The driving unit 251 includes a protruding 253 relative to the second incline 812 of the engaging device 800.

Figure 8A:
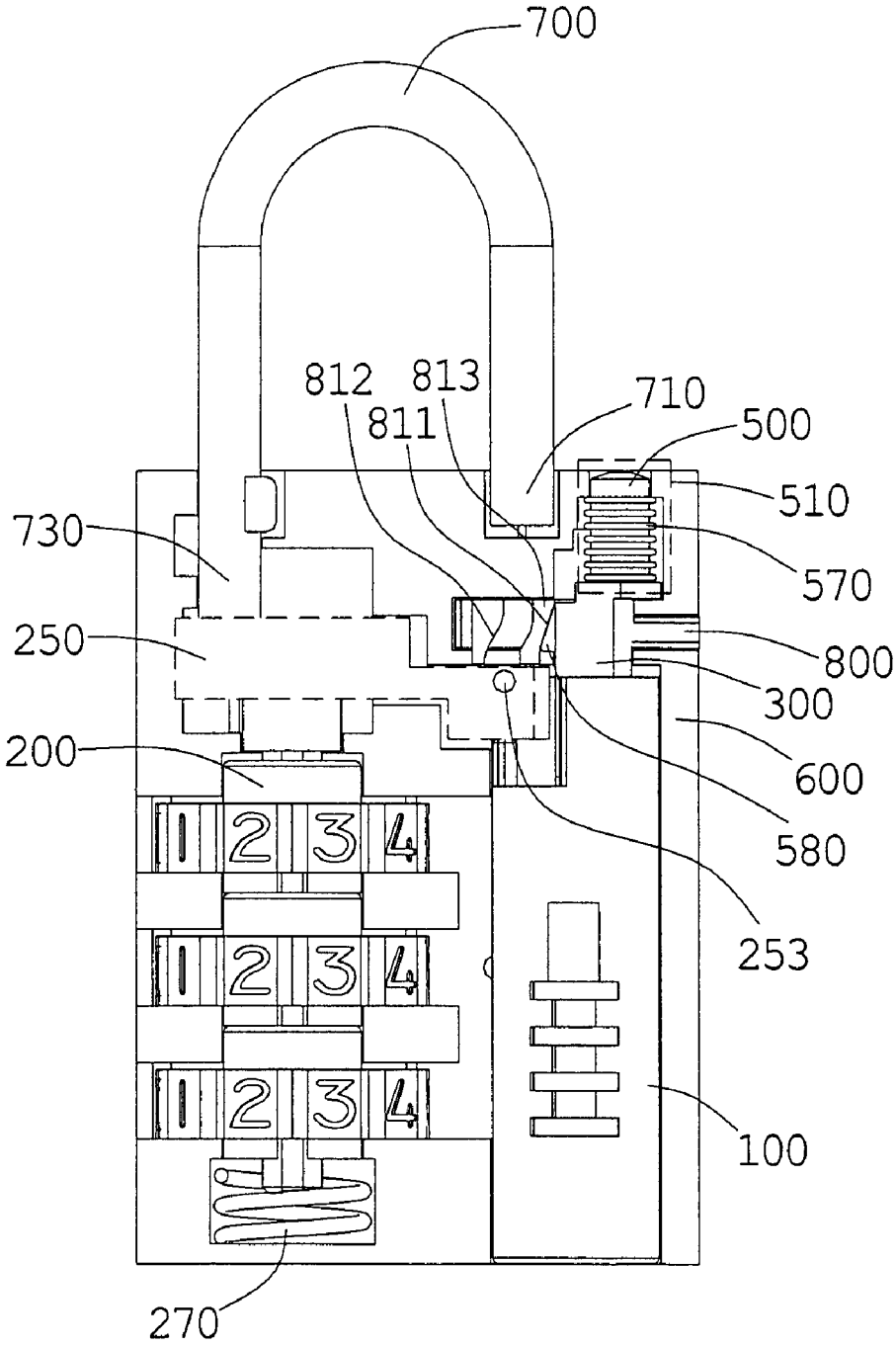
FIG. 8*a* is a side view of the embodiment shown in FIG. 6 when the indication device is located in the first position.
Figure 8B:
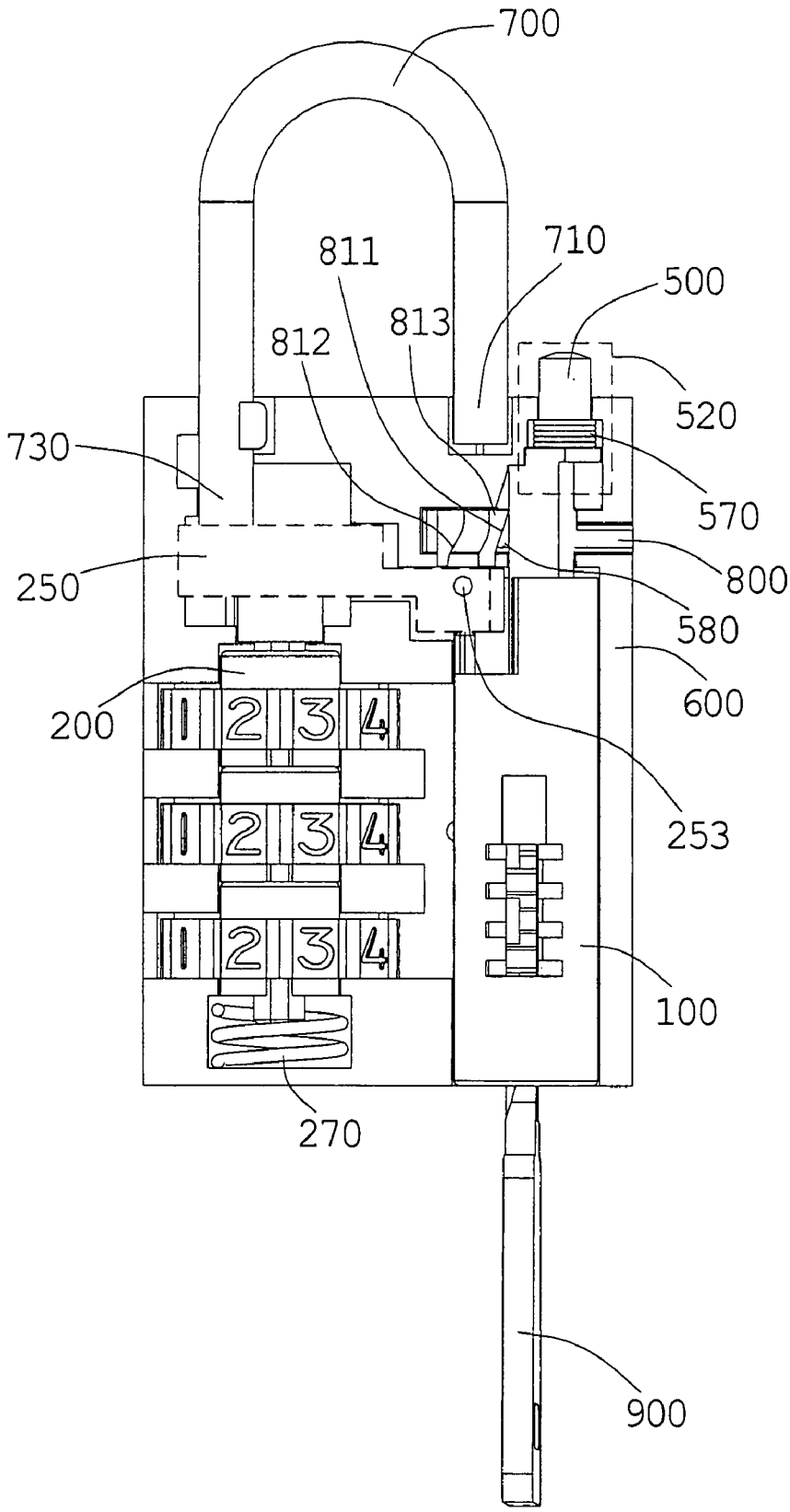
FIG. 8*b* is a side view of the embodiment shown in FIG. 6 when the indication device is located in the second position.
Figure 8C:
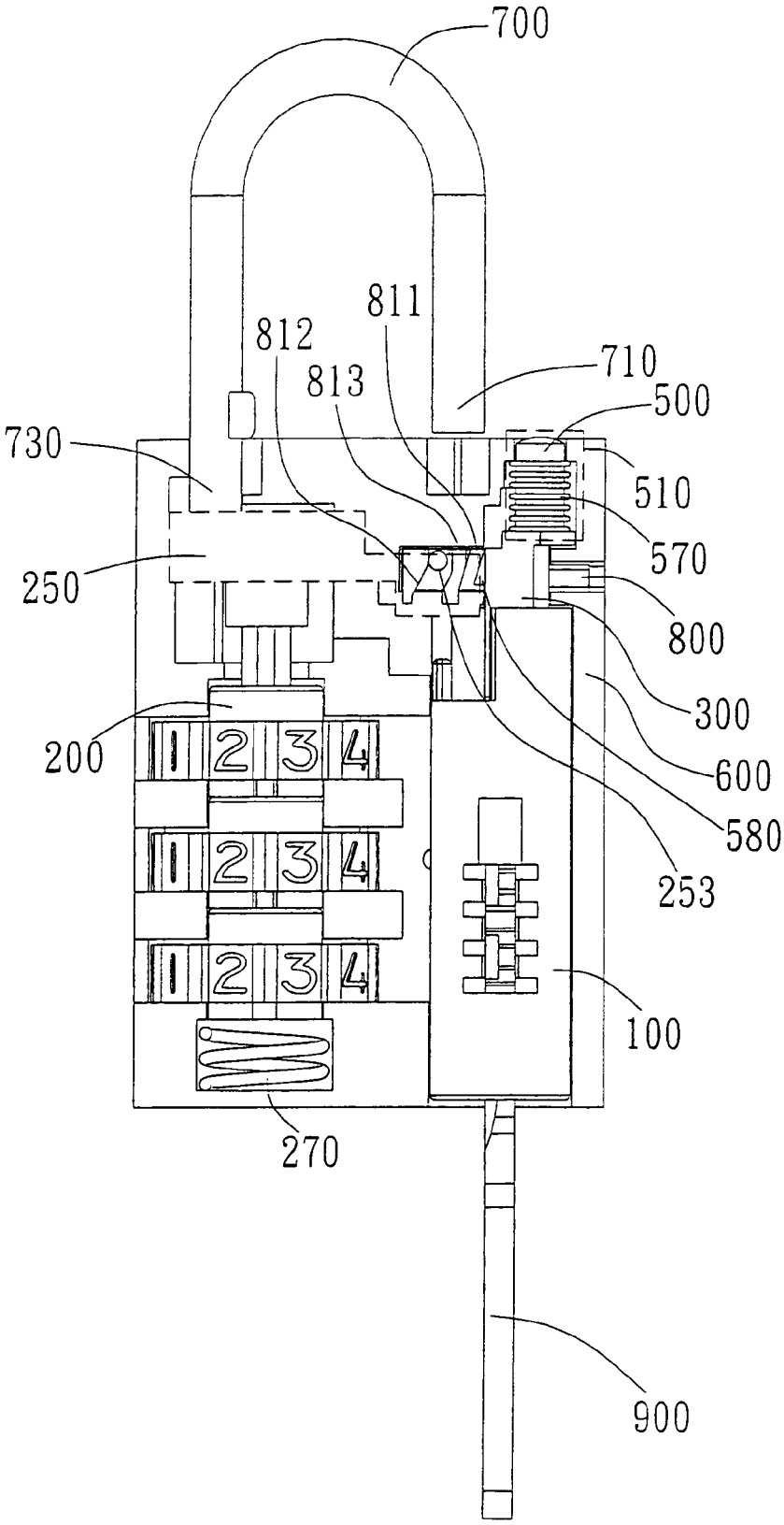
FIG. 8*c* is a side view of the embodiment shown in FIG. 6 when the indication device is shifted back to the first position.

FIG. 8*a*, FIG. 8*b* and FIG. 8*c* exemplarily illustrate the movements of the indication device 500 between the first position 510 and the second position 520. As shown in FIG. 8*a*, when the indication device 500 is shifted from the first position 510 to the second position 520, the second engaging end 580 of the indication device 500 slides along the first incline 811, and the engaging device 800 is shifted back to compress the reverse device 830. As shown in FIG. 8*b*, when the second engaging end 580 is released from the first incline 811 and passes through the first engaging end 813, the reverse device 830 generated a reverse strength and forces the engaging device 800 to shift back to the original position. When the first engaging end 813 and the second engaging end 580 are engaged, the indication device 500 is located in the second position 520.

When the indication device 500 is located in the second position 520 and engaged with the engaging device 800, as shown in FIG. 8*b*, the reverse device 570 is stressed by the indication device and the casing 600 and generates a reverse strength. As shown in FIG. 8*c*, when the connective device 250 is shifted to the engaging device 800, the driving unit 251 slides along the second incline 812 and forces the engaging device 800 to shift back. When the engaging device 800 is shifted back, the misalignment is occurred between the engagement of the second engaging end 580 of the indication device 500 and the first engaging end 813 of the engaging device 800. According to the reverse strength generated from the reverse device 570 of the indication device 500, the reverse strength forces the engaging device 800 to decontrol the limitation of the shifting of the indication device 500 and the indication device 500 is shifted back from the second position 520 to the first position 510 by the reverse strength generated from the reverse device 570 of the indication device 500.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A padlock comprising:

a casing;

a first lock including a key hole and the first lock disposed within the casing;

a driving device, wherein a portion of the driving device is movably disposed within the key hole; and an indication device being able to be moved together with the driving device, wherein the indication device is alternatively moved between a first position and a second position, wherein the first position is the position where the entirety of the indication device is stored within the casing and the second position is the position where the indication device moves a distance out of the casing;

wherein when a key is inserted into the key hole of the first lock, the key forces the driving device to move along the key inserting direction and push the indication device to move the distance out of the casing and protrude out of a top surface of the casing along the key inserting direction without any rotation of the key, wherein a portion of the indication device is exposed by the casing such that the portion of the indication device is visible from outside the casing.

2. The padlock of claim 1, further comprising a shackle having a free end, wherein the free end is disposed within the indication device.

3. The padlock of claim 1, further comprising an engaging device, wherein the engaging device is movably disposed within the casing and used to locate the indication device in the first position and in the second position.

4. The padlock of claim 3, wherein the engaging device including a wedged structure including a first incline and a first engaging end and the first incline and the first engaging end are moved relative to a second engaging end of the indication device.

5. The padlock of claim 4, wherein a reverse device is disposed between the engaging device and the casing; when the indication device is shifted from the first position to the second position, the second engaging end of the indication device slides along the first incline and the engaging device is shifted back to compress the reverse device; when the second engaging end is departed from the first incline to pass through the first engaging end, the reverse device generates a reverse strength to force the engaging device returning to the original position, the first engaging end is engaged with the second engaging end and the indication device is located in the second position.

6. The padlock of claim 3 further comprising a second lock and a connective device connected to the second lock, wherein the connective device includes a driving unit relative to the engaging device.

7. The padlock of claim 6, wherein the second lock and the connective device are disposed within the casing and are movable along an axis of the second lock.

8. The padlock of claim 6, wherein the engaging device includes a second incline relative to the driving unit.

9. The padlock of claim 6, wherein the second lock includes a combination lock.

10. The padlock of claim 1, wherein the first lock includes a key lock.

11. The padlock of claim 1, wherein a top end of the driving device is connected to a bottom end of the indication device.

12. The padlock of claim 1, wherein the indication device includes a reverse device, the reverse device generates a reverse strength forcing the indication device to shift from the second position to the first position.

13. A padlock comprising:

a casing;

a key lock core forming a key hole and the key lock core disposed within the casing;

a driving device, wherein a portion of the driving device is movably disposed within the key hole, the driving device is compelled to move relative to the key lock core when a key is inserted into the key hole;

an indication device being movable together with the driving device, wherein the indication device is alternatively disposed in a first position and a second position, wherein the first position is the position where the entirety of the indication device is stored within the casing and the second position is the position where the indication device moves a distance out of the casing and protrudes out of a top face of the casing, wherein a portion of the indication device is exposed by the casing such that the portion of the indication device is visible from outside the casing;

an engaging device disposed corresponding to the shifting direction of the indication device, wherein the engaging device alternatively locates the indication device in the first position and the second position; and a combination lock disposed within the casing including a connective device, wherein the connective device includes a driving unit relative to the engaging device;

wherein the key is inserted into the key hole, the key forces the driving device to move along the key inserting direction and push the indication device to be disposed in the second position without any rotation of the key.

14. The padlock of claim 13 further comprising a shackle including a free end, wherein the indication device is disposed relative to the free end.

15. The padlock of claim 13, wherein the engaging device including a wedged structure including a first incline and a first engaging end, and the indication device includes a second engaging end relative to the first incline and the first engaging end.

16. The padlock of claim 15, wherein a reverse device is disposed between the engaging device and the casing; when the indication device is shifted from the first position to the second position, the second engaging end of the indication device slides along the first incline and the engaging device is shifted back to compress the reverse device; when the second engaging end is departed from the first incline to pass through the first engaging end, the reverse device generates a reverse strength to force the engaging device returning to the original position, the first engaging end is engaged with the second engaging end and the indication device is located in the second position.

17. The padlock of claim 13, wherein the connective device is movable along an axis of the combination lock.

18. The padlock of claim 13, wherein the engaging device includes a second incline disposed relative to the driving unit.

19. The padlock of claim 13, wherein a top end of the driving device is connected to a bottom end of the indication device.

* * * * *